US011965686B2

(12) United States Patent
Silva et al.

(10) Patent No.: US 11,965,686 B2
(45) Date of Patent: Apr. 23, 2024

(54) BLOCKED COIL DETECTION SYSTEM

(71) Applicant: Regal Beloit America, Inc., Beloit, WI (US)

(72) Inventors: Connor Silva, Tipp City, OH (US); Paul Mullin, Yellow Springs, OH (US); Ramin Rezaei, Centerville, OH (US); Bin Yang, Fort Wayne, IN (US)

(73) Assignee: Regal Beloit America, Inc., Beloit, WI (US)

( * ) Notice: Subject to any disclaimer, the term of this patent is extended or adjusted under 35 U.S.C. 154(b) by 0 days.

(21) Appl. No.: 18/163,058

(22) Filed: Feb. 1, 2023

(65) Prior Publication Data

US 2023/0243560 A1 Aug. 3, 2023

Related U.S. Application Data

(60) Provisional application No. 63/305,518, filed on Feb. 1, 2022.

(51) Int. Cl.
*F25B 49/02* (2006.01)
*F25B 47/02* (2006.01)

(52) U.S. Cl.
CPC ..... *F25B 49/027* (2013.01); *F25B 47/02* (2013.01); *F25B 2500/04* (2013.01); *F25B 2700/11* (2013.01); *F25B 2700/15* (2013.01); *F25B 2700/195* (2013.01)

(58) Field of Classification Search
CPC ..... F25B 47/02; F25B 49/025; F25B 49/027; F25B 2700/11; F25B 2700/15; F25B 2700/195
See application file for complete search history.

(56) References Cited

U.S. PATENT DOCUMENTS

| | | | | |
|---|---|---|---|---|
| 4,037,427 | A | 7/1977 | Kramer | |
| 4,232,528 | A | 11/1980 | Behr | |
| 4,860,551 | A | 8/1989 | Query | |
| 5,065,593 | A | 11/1991 | Dudley | |
| 5,440,890 | A | 8/1995 | Bahel | |
| 6,950,029 | B2 | 9/2005 | Enzinna | |
| 8,346,507 | B2 | 1/2013 | Shahi | |
| 10,690,366 | B2 | 6/2020 | Ensberg | |
| 2006/0010892 | A1* | 1/2006 | Awwad | F25D 29/003 62/180 |
| 2008/0236180 | A1* | 10/2008 | Tran | F25B 49/027 62/181 |

FOREIGN PATENT DOCUMENTS

WO 2018040527 A1 3/2018

* cited by examiner

*Primary Examiner* — Jonathan Bradford
(74) *Attorney, Agent, or Firm* — Armstrong Teasdale LLP

(57) ABSTRACT

A control system for a cooling system configured to selectively operate one or both of a condenser fan an evaporator fan in a reverse direction RD, measure power draw at the motor against configuration data and fan motor profiles, and determine if a blockage has occurred before the static pressure has reached a critical point static pressure where the efficiency, performance, and cooling capability of the cooling system is hindered and maintenance is required to clear the blockage. By determining if blockage has occurred before the static pressure has reached the critical point static pressure, an alert or corrective action can be taken.

20 Claims, 4 Drawing Sheets

BLOCKED COIL DETECTION SYSTEM

CROSS-REFERENCE TO RELATED APPLICATIONS

This application claims priority to U.S. Provisional Application No. 63/305,518 filed Feb. 1, 2022, titled Blocked Coil Detection System; the contents of which are hereby expressly incorporated by reference in their entirety.

BACKGROUND

The field of the disclosure relates generally to a system for controlling and monitoring cooling systems and, more specifically, a control system that detects a blockage in a coil based on data obtained from sensors.

Cooling systems, such as refrigerators and freezers, are used by entities such as grocery stores and warehouses to store or display foods and beverages at a suitable temperature. Evaporator coils and condenser coils can become blocked by foreign bodies, such as dust or ice accumulation, and debris that decrease the airflow across the components.

To detect for blockage, conventional cooling systems can monitor temperature or air flow changes within the cooling system to determine if blockage has occurred in the evaporator coils or condenser coils. Further, cooling systems monitor fan power draw or motor efficiency changes to determine if blockage has occurred. Such systems can only detect blockage when it reaches a critical level and maintenance of the cooling system is required to clear the blockage. In the case of dust or ice accumulation, complete cleaning or de-icing of the coils is required and can cause further down time of the cooling system. Furthermore, when temperature and air flow have dropped to a critical level, the contents stored within the cooling system have to be assessed and often times discarded.

Therefore, there exists a need for a blockage detection system configured to detect early accumulation of blockage in retail and commercial cooling systems, allowing for corrective action before the blockage has reached a critical stage.

BRIEF DESCRIPTION

In one aspect, a server for a control system for a plurality of cooling systems is disclosed. The server comprises a memory device configured to store instructions, and a processor communicatively coupled to said memory device and a plurality of cooling systems, each of the plurality of cooling systems including a motor connected to an axial fan, a motor performance sensor, a local memory, and a microprocessor communicatively coupled to the motor, the motor performance sensor, and the local memory, the microprocessor configured to control operation of the motor according to settings defined by configuration data stored in the local memory. In response to reading the instructions, the processor is configured to instruct the processor of at least one cooling system of the plurality of cooling systems to periodically run the motor in a reverse direction opposite a normal operating direction over a measurement time; receive, from the motor performance sensor of each of a plurality of cooling systems a second reverse sensor data over the measurement time; and, instruct the processor of at least one cooling system of the plurality of cooling systems to determine if power draw from the second reverse data has power draw of the configuration data.

In another aspect, a method for controlling a plurality of cooling systems is disclosed. The method comprises the steps of instructing, by the processor, the processor of at least one cooling system of the plurality of cooling systems to periodically run the motor in a reverse direction opposite a normal operating direction over a measurement time; receiving, at the processor, a second reverse sensor data over the measurement time from the motor performance sensor of each of the plurality of cooling systems; and, instructing, by the processor, the processor of at least one cooling system of the plurality of cooling systems to determine if power draw from the second reverse data has exceeded power draw of the configuration data In another aspect, a control system is disclosed. The control system comprises a plurality of cooling systems, each cooling system of said plurality of cooling systems including a motor connected to a fan operable in a forward direction and a reverse direction, the fan positioned before a coil of a cooling system of the plurality of cooling systems; a motor performance sensor; a local memory; and a processor communicatively coupled to said motor, said motor performance sensor, and said memory and configured to control operation of said motor according to settings defined by configuration data stored in said memory, and a server comprising a processor communicatively coupled to said plurality of cooling systems and communicatively coupled to a memory device configured to store instructions. In response to reading the instructions, the processor is configured to instruct the processor of at least one cooling system of the plurality of cooling systems to periodically run the motor in a reverse direction opposite a normal operating direction over a measurement time; receive, from the static air pressure sensor and motor performance sensor of each of a plurality of cooling systems a second reverse sensor data over the measurement time; and, instruct the processor of at least one cooling system of the plurality of cooling systems to determine if power draw from the second reverse data has exceeded power draw of the configuration data.

DETAILED DESCRIPTION

Embodiments of the disclosed control system and methods of controlling a cooling system utilize a cloud network to generate and store data (sometimes referred to herein as "configuration data") defining fan motor profiles and settings according to which the motors of individual cooling systems are controlled. The control system uses sensor data obtained from each of the cooling systems in addition to other data input from users or retrieved from sources within the cloud network to generate the configuration data, and instructs microcontrollers of the cooling systems to control corresponding motors according to the generated configuration data. Accordingly, the configuration data may be generated using an increased number and variety of data sources such that, when set for a particular cooling system, the configuration data can be compared against sensor data to determine if blockage has occurred in condenser coils and evaporator coils.

Figure 1:
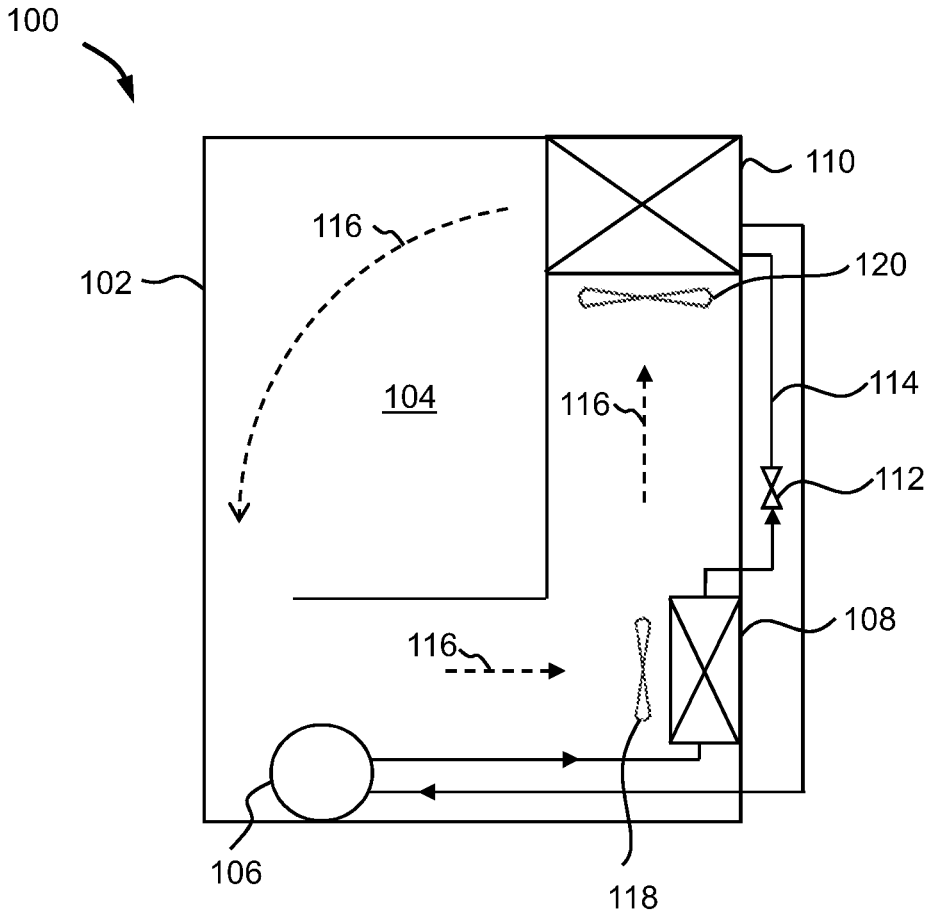
FIG. 1 is a schematic representation of an example cooling system.

FIG. 1 is a schematic representation of a cooling system 100. The cooling system 100 comprises an enclosure 102 defining an interior space 104, a compressor 106, a condenser 108, an evaporator 110, an expansion valve 112 and a controller. In some embodiments, the interior space 104 has a door or opening though which contents may be inserted, stored, or displayed in the enclosure 102. The compressor 106, condenser 108, evaporator 110 and expansion valve 112 are fluidly connected by refrigeration tubes 114 to form a refrigeration circuit, and air 116 is circulated through the cooling unit 100 to cool contents within the interior space 104. The air 116 is circulated by a condenser fan 118 positioned before the condenser 108, and by an evaporator fan 120 positioned before the evaporator 110. The condenser fan 118 and evaporator fan 120 push air 116 into the condenser 108 and evaporator 110 respectively. The condenser fan 118 and evaporator fan 120 have a normal operating direction or "forward direction." In some embodiments, one or both of the condenser fan 118 and evaporator fan 120 can be operated in a "reverse direction" which is opposite the forward direction. The condenser fan 118 or evaporator fan 120 are operable in the reverse direction by sending a signal to a motor coupled to the condenser fan 118 or evaporator fan 120 to run in an opposite direction to a normal operating direction.

Figure 2:
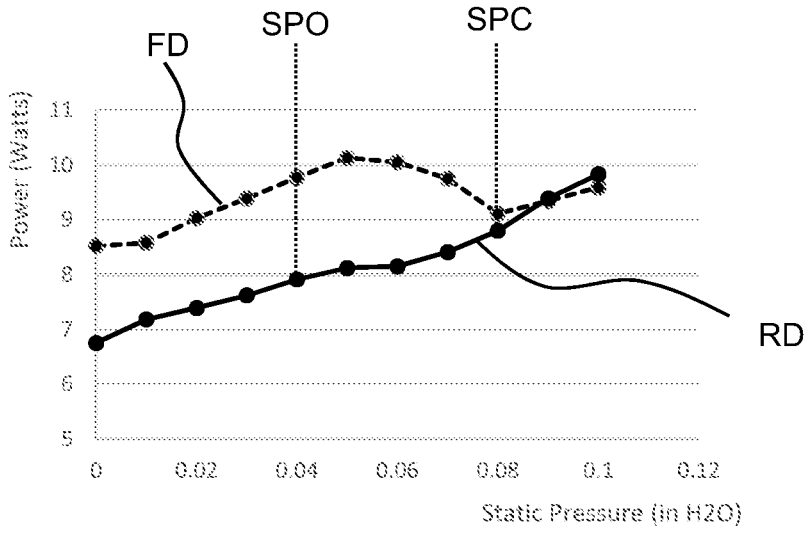
FIG. 2 illustrates static pressure curves over motor power for an axial fan.

FIG. 2 illustrates static pressure curves over motor power for an axial fan in the forward direction FD and an axial fan in the reverse direction RD. The forward direction FD is a direction which follows the circulation of air 116 of FIG. 1.

Air 116 pushed into coils of the condenser 108 and evaporator 110 by condenser fan 118 and evaporator fan 120 respectively can be measured in static pressure by one or more static pressure sensors, and during normal operation, the air 116 has an operative static pressure SPO over the coils. Condensation, ice, and more generally, debris can accumulate on coils of the condenser 108 and evaporator 110, causing blockage and a progressive increase in static pressure over the coils. Blockage can increase the static pressure to a critical point static pressure SPC where the efficiency, performance, and cooling capability of the cooling system 100 is hindered and maintenance is required to clear the blockage.

By way of example, for an example cooling system, the operative static pressure SPO is up to 0.04 inches of water column ("in. H2O"), and a critical point static pressure SPC is more than 0.08 H2O. As the blockage increases, power draw (measured in watts) also increases, hindering performance of the fan and motor. As shown, for a forward direction FD axial fan, power draw increases substantially linearly until a static pressure of roughly 0.05 H2O and subsequently falls off nonlinearly. In some embodiments, the values and ranges of the operative static pressure SPO and is critical point static pressure SPC determined by characteristics of the cooling system 100.

While static pressure sensors can be configured to measure for blockage, static pressure sensors are not commonly incorporated into cooling systems existing in consumer and commercial applications. In a cooling system where power draw alone is used to detect blockage, a motor performance sensor for measuring power draw would be unable to differentiate a static pressure of, by way of example, 0.04 H2O (which is in the operative static pressure SPO range) and a static pressure of 0.08 (which is in the critical point static pressure SPC range). Unlike the forward direction FD axial fan, the reverse direction RD axial fan has a linear relationship between static pressure and power raw throughout the operative static pressure SPO range and critical point static pressure SPC range. However, operating a fan in the reverse direction will cause undesirable heating of the example cooling system.

As explained in further detail below, embodiments of the present disclosure selectively operate one or both of the condenser fan 118 and evaporator fan 120 in the reverse direction RD, measure power draw at the motor at the coils against configuration data and fan motor profiles, and determine if a blockage has occurred before static pressure has reached the critical point static pressure SPC where the efficiency, performance, and cooling capability of the cooling system 100 is hindered and maintenance is required to clear the blockage. By determining if blockage has occurred before the static pressure has reached the critical point static pressure SPC, an alert or corrective action can be taken without requiring maintenance.

Figure 3:
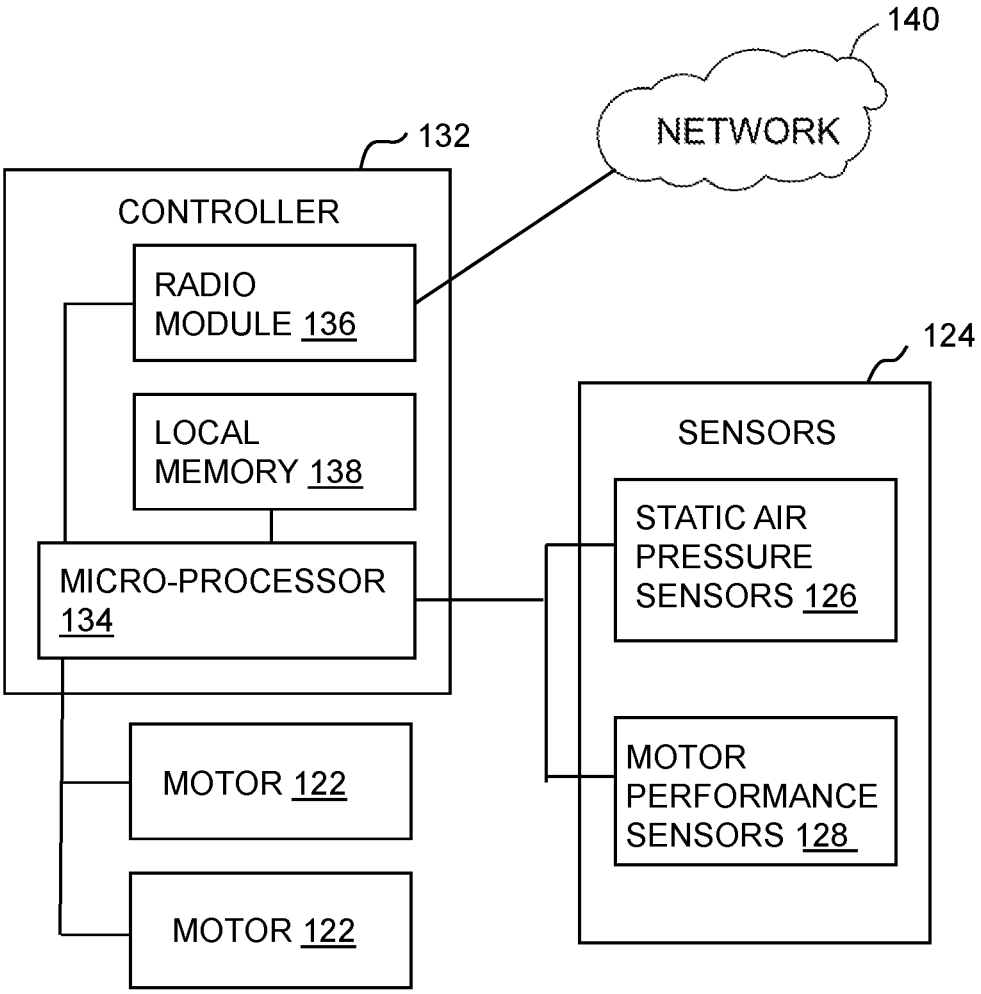
FIG. 3 is a block diagram of a control system for detecting a blocked coil.

FIG. 3 is a block diagram of the cooling system 100. The cooling system 100 further includes one or more motors 122, a controller 132 and one or more sensors 124 such as, for example, a static air pressure sensor 126, and a motor performance sensor 128. As explained in further detail below, data measurements from the static air pressure sensor 126 and the motor performance sensor 128 can be used to create a fan motor profile during an initial calibration and configuration step. The fan motor profile for a fan-motor configuration can also be uploaded to a server or local memory, thus the static air pressure sensor 126 is optional. The example control system 200 of FIG. 4 can be installed or retrofitted to existing cooling systems without having to also include a static air pressure sensor.

Motors 122 use electrical power to rotate a mechanical load. For example, motors 122 may be mechanically coupled to the condenser fan 118, the evaporator fan 120, or the compressor 106 of cooling system 100. As such, motors 122 enable the cooling of the interior space 104 in flow communication with cooling system 100 such as, for example, a food storage space of a refrigerator or freezer. In certain embodiments, motors 122 are electronically commutated motors (ECMs). Motors 122 are communicatively coupled to the controller 132 and are configured to operate in response to a control signal generated by the controller 132. In some embodiments, the controller is a thermostat unit. Motors 122 are capable of changing operation based on the control signal. For example, in response to the control signal, motors 122 may activate or deactivate, or operate according to a specified speed, torque, power, reverse direction or another parameter.

Sensors 124 are configured to detect physical properties of cooling system 100 or its environment and generate a sensor signal that represents data (sometimes referred to herein as "sensor data") collected by sensors 124. For example, static air pressure sensor 126 detects a static air pressure, and motor performance sensor 128 detects operating performance characteristics of motors 122, such as, for example, a speed, torque, fault status, energy use, power draw (watts), vibration, or run time of motors 122. Cooling system 100 may also include additional sensors to detect other properties of cooling system 100 and its environment.

Controller 132 includes a microprocessor 134 and a local memory 138. In some alternative embodiments, microprocessor 134 and local memory 138 are incorporated into one or more of motors 122. Microprocessor 134 is communicatively coupled to motors 122 and sensors 124 using, for example, a wired Modbus connection. Microprocessor 134 is configured to read instructions stored in local memory 138 and generate the control signal for motors 122 based on the instructions and sensor data received from sensors 124. Such instructions include data (sometimes referred to herein as "configuration data") that define settings under which microprocessor 134 controls the operation of motors 122, for example, by specifying a particular control signal output for a given sensor data input. For example, in some embodiments, microprocessor 134 receives power data and motor direction data from motor performance sensor 128 and selects a speed, torque, power or direction at which to operate one or more of motors 122 by executing an algorithm on the received power data and motor direction data such as, for example, a lookup table or a formula (e.g., a polynomial function determined by regression analysis). In some embodiments, microcontroller further controls operation of motors 122 based on humidity data, air pressure data, motor performance data, other data, or a combination thereof in a similar manner as described with respect to power data and motor direction data.

Figure 4:
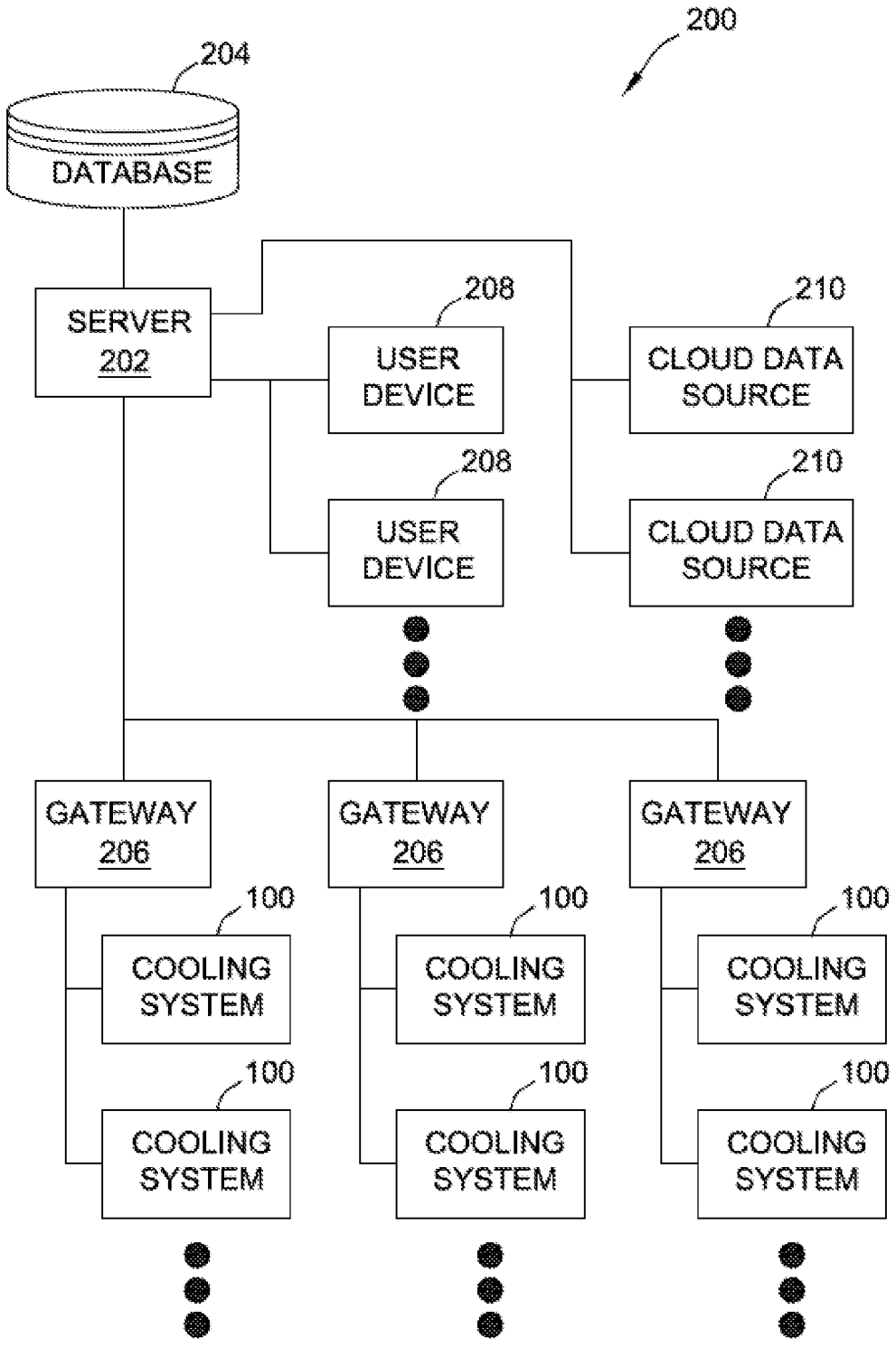
FIG. 4 is a block diagram of an example control system for controlling the cooling system depicted in FIGS. 1 and 3.
Figure 5:
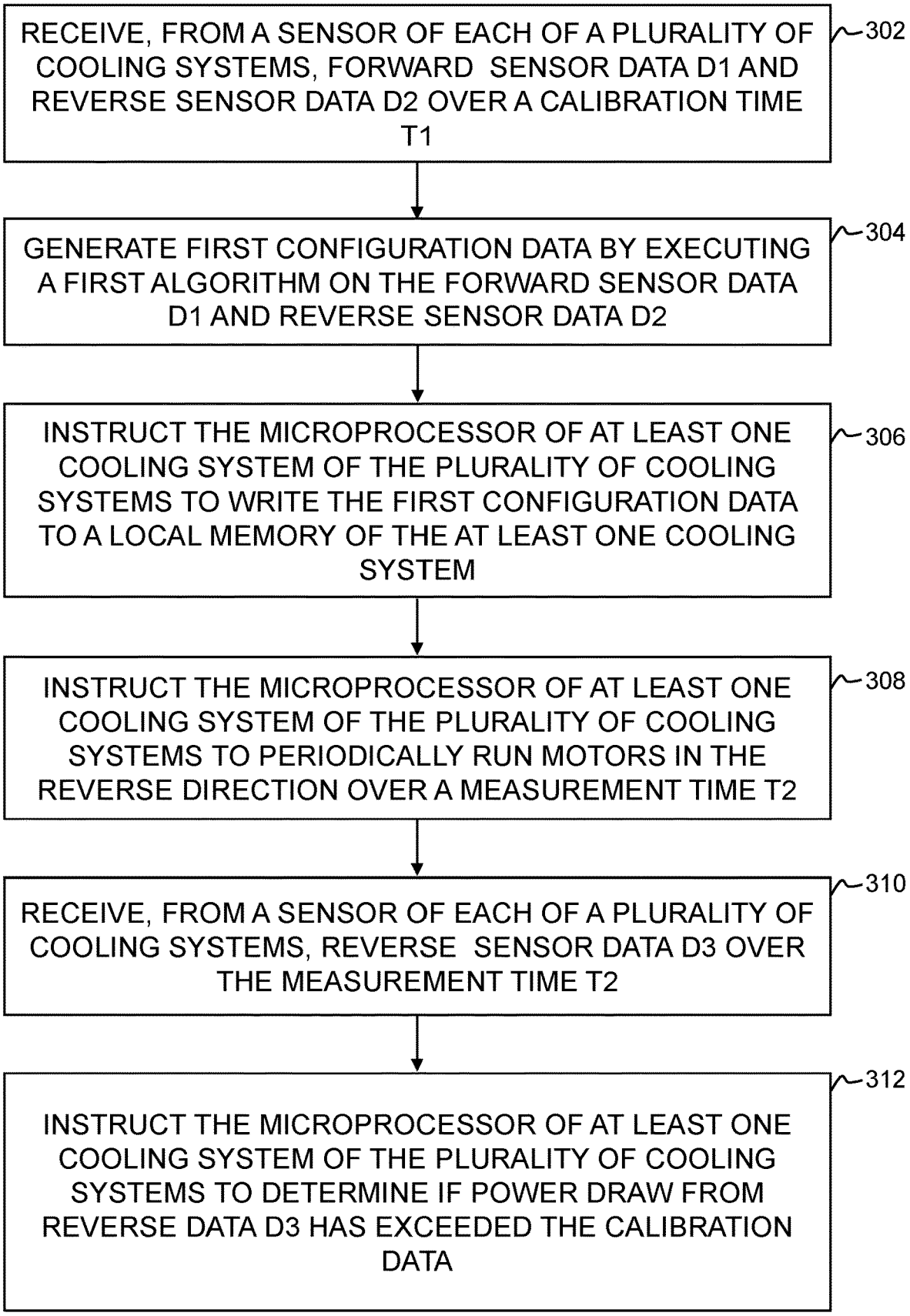
FIG. 5 is a flow diagram of an example method of controlling a plurality of cooling systems.

Controller 132 is further in communication with a network 140 (shown in more detail with respect to FIG. 4). For example, in some embodiments, controller 132 further includes a radio module 136 communicatively coupled to microprocessor 134, through which microprocessor 134 can communicate with network 140. In some embodiments, radio module 136 is configured communicate with other elements of the network using a specific communications protocol such as, for example, ZigBee 3.0 or Bluetooth Low Energy.

As described in further detail with respect to FIG. 4, communicating with network 140 enables microprocessor 134 to receive new or updated configuration data, or instructions to modify configuration data, and write the updated configuration data to local memory 138, or modify the configuration data stored in local memory 138. Accordingly, the settings under which microprocessor 134 controls motors 122 may be adjusted remotely. In some embodiments, microprocessor 134 is further configured to transmit sensor data received from sensors 124 to other locations of network 140.

FIG. 4 is a block diagram of an example control system 200. Control system 200 includes a plurality of cooling systems 100, a server 202, a database 204, one or more gateways 206, one or more user devices 208, and one or more cloud data sources 210. Cooling systems 100 generally function as described with respect to FIGS. 1 through 4. Network 140 shown in FIG. 2 may include one or more of server 202, database 204, user devices 208, cloud data sources 210, and other cooling systems 100.

Server 202 is communicatively coupled to each cooling system 100. In some embodiments, each cooling system 100 is communicatively coupled with one of the plurality of gateways 206, for example, via a wireless connection, such as a Bluetooth or ZigBee connection, or via a wired connection, such as an Ethernet connection. Each gateway 206 is in turn communicatively coupled to server 202 to form a communicative connection between each cooling system 100 and server 202. In some embodiments, each gateway 206 and server 202 are communicatively coupled via the Internet, for example, via one or more of a wireless local area network (WLAN), a cellular network, or another computer network that allows data to be exchanged between server 202 and each gateway 206. To enable data exchange between server 202, gateway 206, and other components of control system 200, such networks may utilize various communications protocols such as, for example, Wi-Fi, Ethernet, Bluetooth, or ZigBee. In some embodiments, each gateway 206 corresponds to a specific site such as, for example, a store or warehouse having one or more cooling systems 100.

As described with respect to FIG. 2, each cooling system includes a microprocessor 134 configured to read configuration data from and write configuration data to local memory 138. Server 202 includes a processor configured to generate configuration data and instruct the microprocessor 134 of each cooling system 100 to write the generated configuration data to local memory 138. Alternatively, in some embodiments, server 202 writes configuration data directly to local memory 138 or to a memory incorporated into one or more of motors 122. By so doing, server 202 is capable of modifying the configuration data and corresponding settings of each cooling system 100. Server 202 generates the modified configuration data based on one or more data inputs such as, for example, manual user input, sensor data obtained from cooling systems 100, or data obtained from cloud data sources 210 (e.g., via the Internet). Server 202 may execute algorithms on such input data to generate configuration data. For example, in some embodiments, server 202 is configured to generate configuration data by executing on the received input data an algorithm such as, for example, a lookup table or a formula (e.g., a polynomial function determined by regression analysis). Additionally, or alternatively, in some embodiments, server 202 may further be configured to generate configuration data using artificial intelligence (AI) or machine learning techniques.

In some embodiments, algorithms executed by server 202 to generate configuration data include, for example, fan speed and direction algorithms, fan motor profiles or load shaving algorithms, wherein cooling systems 100 are reconfigured to reduce, increase or reverse direction of motors 122 if coil blockage is detected as described in further detail below. In some such embodiments, server 202 uses data received from cooling systems 100. For example, cooling systems 100 having coil blockage may have fan speeds altered or momentarily reversed to implement algorithms to check for coil blockage and send a signal or warning to the network 140. Other algorithms executed by server 202 produce a data output, but not necessarily a control output. Such algorithms may be used by server 202 to build a fan motor profile during normal operation where a coil blockage does not exist. For example, motor performance data can be used to determine when blockage is present in the coils for a particular cooling system 100 by comparing motor performance data with the fan motor profile. In some such embodiments, server 202 may determine that an alarm or error condition is present based on an increase in motor power draw, current, speed, or torque of the motor in comparison to expected fan motor profiles and motor performance data based on actual data received from sensors 124.

Using such algorithms, server 202 can generate configuration data that causes cooling systems 100 to achieve certain operating characteristics, such as operating with greater energy efficiency. For example, an environment (e.g., external weather, temperature, humidity, air pressure, etc.) of a cooling system 100 may affect its ability to meet a cooling demand while operating motors 122 at a certain power level. By generating configuration data for each cooling system 100 at server 202, the configuration data stored at each cooling system 100 can be set, for example, to cause motors 122 of each cooling system 100 to operate at a minimum power level that still allows the corresponding cooling system 100 to meet its cooling demand requirement. This power level may be different for each cooling system 100 or groups of cooling systems 100 (e.g., the cooling systems at a particular store), and as such, server 202 is configured to separately generate configuration data for each cooling system 100 or group of cooling systems 100.

In some embodiments, server 202 is further communicatively coupled to database 204. In some such embodiments, server 202 stores sensor data received from cooling systems 100 in database 204. As described above, server 202 can use such sensor data as a data input for generating updated fan motor profiles and configuration data generally. Server 202 can further use such sensor data to compute statistics such as, for example, average energy usage for a given cooling system 100 or set of cooling systems 100 when generating updated fan motor profiles.

In some embodiments, server 202 is further communicatively coupled to user devices 208. User devices 208 may be, for example, personal computers (PCs), tablet computers, smart telephones, and/or other such computing devices. In such embodiments, server 202 is configured to cause user devices 208 to display a user interface, through which a user may interact with control system 200. For example, in some such embodiments, user devices 208 are configured to run an application, or "app," through which a user may, for example, adjust settings for cooling systems 100 or view data related to cooling systems 100, such as, for example, total usage, energy usage, or error data. In some such embodiments, server 202 is configured to compute one or more metrics based on received sensor data such as, for example, an average energy usage, average power, or total amount of time activated of a particular cooling system 100, motor 122, or group of cooling systems corresponding to a particular site or gateway 206. In such embodiments, server 202 is configured to instruct user devices 208 to display the computed metric via the user interface. In certain such embodiments, the user interface displayed at each user device 208 may enable to the user to input commands to control one or more of cooling systems 100. In such certain embodiments, each user device 208 generates a command message and transmits the command message to server 202. In response to the command message, server 202 generates updated configuration data and instructs microprocessor 134 of a cooling system 100 specified by the user input to write the second configuration data to local memory 138 of the specified cooling system 100.

In some embodiments, server 202 is further communicatively coupled to cloud data sources 210. Examples of cloud data sources 210 include computing devices and databases from which server 202 can retrieve data (sometimes referred to herein as "cloud data") via a network connection (e.g., via the Internet). For example, in some embodiments, cloud data sources 210 include one or more of sources of weather data, sources of data regarding the sites of cooling systems 100 (e.g., computers associated stores or warehouses owning one or more of cooling systems 100), or other sources of data relevant to the operating environment of cooling systems 100. Server 202 is configured to retrieve such data from cloud data sources 210, generate updated configuration data based on the retrieved data, and instruct microprocessor 134 of a cooling system 100 specified by the user input to write the second configuration data to local memory 138 of the specified cooling system 100. For example, server 202 may generate configuration data for a given cooling system 100 taking into account, for example, an outside temperature and/or humidity of a location of the given cooling system 100, or the make and model of one or more fans or motors.

In some embodiments, server 202 communicates directly with sensors 124 of each cooling system 100, rather than through controller 132. In such embodiments, sensors 124 can be installed onto existing equipment, enabling server 202 to monitor the existing equipment, for example, by monitoring the health of motors 122, cooling systems 100, and/or groups of cooling systems 100 as a whole. For example, server 202 can detect failed temperature control, defrost cycles, low refrigerant charge, or other parameters using sensors 124. Further, in some such embodiments, server 202 can detect though secondary means what a local controller such as controller 132 is doing, for example, by detecting when cooling system 100 is cooling based on temperature, motor torque, motor vibration, and/or other indicator properties of cooling system 100 and its components.

FIG. 4 is a flow diagram of an example method 300 of controlling cooling systems, such as cooling system 100 shown in FIG. 1. Method 300 may be embodied in a control system having a server, such as control system 200 and server 202 shown in FIG. 4. Control system 200 may perform method 300 periodically or in response to certain events such as, for example, input from a user or a sensor.

Server 202 receives 302, from sensors 124 of each of the plurality of cooling systems 100, first sensor data. In some embodiments, the first sensor data is generated by one or more of static air pressure sensor 126, and motor performance sensor 128, and another type of sensor 124 included in cooling system 100, and is transmitted to server 202 by microprocessor 134 via radio module 136 and gateway 206.

In some embodiments, the first sensor data includes one or more of a forward sensor data D1, and a reverse sensor data D2. In some embodiments, the one or more of the condenser fan 118 and evaporator fan 120 are operated for a first calibration time T1 to gather forward sensor data D1 during normal operation when a blockage is not present in the coils of the condenser 108 and evaporator 110. In some embodiments, the one or more of the condenser fan 118 and evaporator fan 120 are operated in the reverse direction over the first calibration time T1 to gather reverse data D2 during reverse operation when a blockage is not present in the coils of the condenser 108 and evaporator 110. The forward sensor data D1 and reverse sensor data D2 include data measurements from static air pressure sensors 126 at the coils and motor performance sensors 128 of motors 122. The motor performance sensors 128 detects at least power draw of the motors 122 connected to one or more of the condenser fan 118 and evaporator fan 120.

Server 202 then generates 304 first configuration data by executing a first algorithm on the forward sensor data D1 and reverse sensor data D2. In some embodiments, the first algorithm is one or more of a lookup table or a formula (e.g., a polynomial function determined by regression analysis) that generates given output configuration data based on a particular combination of input sensor data.

In some embodiments, the first configuration data includes fan motor profiles generated by executing an algorithm to determine operative static pressure SPO and critical point static pressure SPC in both forward direction and reverse direction of the condenser fan 118 and the evaporator fan 120 for the cooling system 100 using forward sensor data D1 and reverse sensor data D2. Stated differently, the forward sensor data D1 and reverse sensor data D2 generate fan motor profiles for an example cooling system.

Server 202 then instructs 306 microprocessor 134 of at least one cooling system 100 of the plurality of cooling systems 100 to write the first configuration data to local memory 138 of the at least one cooling system 100. For example, in some embodiments, server 202 compiles instructions based on the generated configuration and transmits the instructions to microprocessor 134 via gateway 206 and radio module 136. The instructions, when executed by microprocessor 134, cause microprocessor 134 to write the first configuration data to local memory 138. Once the first configuration data is stored in local memory 138, microprocessor 134 controls motors 122 based on settings defined by the first configuration data.

Steps 302, 304 and 306 are calibration steps to determine fan motor profiles of the first configuration data. Fan motor profiles can alternatively be stored in local memory 138 or server 202 during installation of the cooling system 100. Thus, in some embodiments, calibration steps 302, 304, 306 are optional.

Server 202 then instructs 308 microprocessor 134 of at least one cooling system 100 of the plurality of cooling systems 100 to periodically run the motors 122 in the reverse direction for a measurement time T2. In some embodiments, the server 202 instructs 308 microprocessor 134 of at least one cooling system 100 of the plurality of cooling systems 100 to run the motors 122 in the reverse direction for a measurement time T2 once per day.

Server 202 then receives 310, from sensors 124 of each of the plurality of cooling systems 100, second sensor data. The second sensor data is generated by motor performance sensor 128, and is transmitted to server 202 by microprocessor 134 via radio module 136 and gateway 206. In some embodiments, the second sensor data is stored to local memory 138.

In some embodiments, the second sensor data includes a reverse sensor data D3 from the motor performance sensor 128 over the second measurement time T2. The motor performance sensors 128 detects at least power draw of the motors 122 connected to one or more of the condenser fan 118 and evaporator fan 120.

Server 202 then instructs 312 microprocessor 134 of at least one cooling system 100 of the plurality of cooling systems 100 to determine if power draw from reverse sensor data D3 exceed the operative static pressure SPO by executing an algorithm to determine if power draw of the motors 122 has exceeded data values of the fan motor profiles of the first configuration data stored in local memory 138. In some embodiments, if the microprocessor 134 has determined that power draw from reverse sensor data D3 has exceeded data values of the fan motor profiles of the first configuration data stored in local memory 138, a blockage has occurred and the server 202 then instructs the microprocessor 134 to send alert data to the network 140.

By running the motors 122 in the reverse direction, the fan motor profile has a different and advantageous curve relative to the forward direction, where efficiency of the fan is lower but there is a measurable change in power draw versus static pressure. Furthermore, the control system 200 and method steps do not require reading data from a static pressure sensor for steps 308, 310 and 312.

In some embodiments, if blockage has occurred at the coils of the evaporator 110, the server 202 then instructs microprocessor 134 of at least one cooling system 100 of the plurality of cooling systems 100 to run motors 122 of the evaporator fan 120 to run in the reverse direction for a period of time T3 such that the coils of the evaporator 110 is de-iced. In some embodiments, if blockage has occurred at the coils of the evaporator 110, the server 202 then instructs microprocessor 134 of at least one cooling system 100 of the plurality of cooling systems 100 to run motors 122 of the evaporator fan 120 in the forward direction at a faster rotational speed for a period of time T3 such that the coils of the evaporator 110 is de-iced.

The calibration time T1 is selected to allow for enough data collection to create the first configuration data. The measurement time T2 is selected to allow for enough data collection to determine if one or more of the static air pressure or power draw from reverse sensor data D3 exceed the operative static pressure SPO by executing an algorithm to determine if power draw of the motors 122 has exceeded data values of the fan motor profiles of the first configuration data stored in local memory 138. In some embodiments, the measurement time T2 is 2 minutes. In some embodiments, the measurement time T2 is 3 minutes.

In some embodiments, blockage can be detected and a warning is sent at a coil blockage of 50% to 80%.

The methods and systems described herein may be implemented using computer programming or engineering techniques including computer software, firmware, hardware or any combination or subset thereof, wherein the technical effect may include at least one of: (a) improving energy efficiency of motors in cooling systems by operating the motors according to settings defined by configuration data generated based on sensor data; and (b) increasing the efficiency by which a user may control cooling systems located at various sites by utilizing a server communicatively coupled to a user device that displays a user interface and communicatively coupled to the cooling systems through a combination of gateways and wireless connections.

In the foregoing specification and the claims that follow, a number of terms are referenced that have the following meanings.

As used herein, an element or step recited in the singular and preceded with the word "a" or "an" should be understood as not excluding plural elements or steps, unless such exclusion is explicitly recited. Furthermore, references to "example implementation" or "one implementation" of the present disclosure are not intended to be interpreted as excluding the existence of additional implementations that also incorporate the recited features.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here, and throughout the specification and claims, range limitations may be combined or interchanged. Such ranges are identified and include all the sub-ranges contained therein unless context or language indicates otherwise.

Some embodiments involve the use of one or more electronic processing or computing devices. As used herein, the terms "processor" and "computer" and related terms, e.g., "processing device," "computing device," and "controller" are not limited to just those integrated circuits referred to in the art as a computer, but broadly refers to a processor, a processing device, a controller, a general purpose central processing unit (CPU), a graphics processing unit (GPU), a microcontroller, a microcomputer, a programmable logic controller (PLC), a reduced instruction set computer (RISC) processor, a field programmable gate array (FPGA), a digital signal processing (DSP) device, an application specific integrated circuit (ASIC), and other programmable circuits or processing devices capable of executing the functions described herein, and these terms are used interchangeably herein. The above embodiments are examples only, and thus are not intended to limit in any way the definition or meaning of the terms processor, processing device, and related terms.

In the embodiments described herein, memory may include, but is not limited to, a non-transitory computer-readable medium, such as flash memory, a random access memory (RAM), read-only memory (ROM), erasable programmable read-only memory (EPROM), electrically erasable programmable read-only memory (EEPROM), and non-volatile RAM (NVRAM). As used herein, the term "non-transitory computer-readable media" is intended to be representative of any tangible, computer-readable media, including, without limitation, non-transitory computer storage devices, including, without limitation, volatile and non-volatile media, and removable and non-removable media such as a firmware, physical and virtual storage, CD-ROMs, DVDs, and any other digital source such as a network or the Internet, as well as yet to be developed digital means, with the sole exception being a transitory, propagating signal. Alternatively, a floppy disk, a compact disc-read only memory (CD-ROM), a magneto-optical disk (MOD), a digital versatile disc (DVD), or any other computer-based device implemented in any method or technology for short-term and long-term storage of information, such as, computer-readable instructions, data structures, program modules and sub-modules, or other data may also be used. Therefore, the methods described herein may be encoded as executable instructions, e.g., "software" and "firmware," embodied in a non-transitory computer-readable medium. Further, as used herein, the terms "software" and "firmware" are interchangeable, and include any computer program stored in memory for execution by personal computers, workstations, clients and servers. Such instructions, when executed by a processor, cause the processor to perform at least a portion of the methods described herein.

Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the example embodiment, additional output channels may include, but not be limited to, an operator interface monitor.

The systems and methods described herein are not limited to the specific embodiments described herein, but rather, components of the systems and/or steps of the methods may be utilized independently and separately from other components and/or steps described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to provide details on the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A server for a control system for a plurality of cooling systems, said server comprising:

a memory device configured to store instructions; and a processor communicatively coupled to said memory device and a plurality of cooling systems, each of the plurality of cooling systems including a motor connected to an axial fan, a motor performance sensor, a local memory, and a microprocessor communicatively coupled to the motor, the motor performance sensor, and the local memory, wherein the microprocessor is configured to control operation of the motor according to settings defined by configuration data stored in the local memory, wherein in response to reading the instructions, said processor is configured to:

instruct the microprocessor of at least one cooling system of the plurality of cooling systems to periodically run the corresponding cooling system motor in a reverse direction opposite a normal operating direction over a measurement time;

receive, from the motor performance sensor of each of the plurality of cooling systems, a measurement sensor data over the measurement time; and, instruct the processor of at least one cooling system of the plurality of cooling systems to determine if power draw from the measurement sensor data has exceeded power draw of the configuration data.

2. The server of claim 1, each of the plurality of cooling systems further comprising a static air pressure sensor in communication with the respective microprocessor, wherein in response to reading the instructions, said processor is further configured to:

receive, from the static air pressure sensor and motor performance sensor of each of the plurality of cooling systems, a calibration sensor data over a calibration time;

generate first configuration data by executing a first algorithm using the calibration sensor data; and, instruct the microprocessor of at least one cooling system of the plurality of cooling systems to write the first configuration data to the local memory of the at least one cooling system.

3. The server of claim 2, wherein the static air pressure sensor of each of the plurality of cooling systems measures static pressure over a coil of a condenser of the respective cooling system and the motor performance sensor of each of the plurality of cooling systems measures power draw of the motor connected to the axial fan of the respective cooling system.

4. The server of claim 3, wherein calibration and measurement sensor data includes data measurements from the static air pressure sensor at the coil of each of the plurality of cooling systems and motor performance sensors of each of the plurality of cooling systems.

5. The server of claim 4, wherein the first configuration data includes a fan motor profile generated by executing an algorithm to determine operative static pressure of the cooling system having the motor operating in the reverse direction.

6. The server of claim 5, wherein the server instructs the microprocessor of at least one cooling system of the plurality of cooling systems to determine whether power draw from the measurement sensor data exceeds power draw of the configuration data stored in local memory.

7. The server of claim 6, wherein if the microprocessor has determined that power draw from the measurement sensor data has exceeded data values of the fan motor profile of the first configuration data stored in local memory, the server instructs the microprocessor to send alert data to a network.

8. The server of claim 6, wherein if the microprocessor has determined that power draw from the measurement sensor data has exceeded data values of the fan motor profile of the first configuration data stored in local memory, the server instructs the microprocessor to run the motor in a forward direction at an increased rotational speed for a period of time such that the coil is de-iced.

9. The server of claim 6, wherein if the microprocessor has determined that power draw from the measurement sensor data has exceeded data values of the fan motor profile of the first configuration data stored in local memory, the server instructs the microprocessor to run the motor in the reverse direction for a period of time such that the coil is de-iced.

10. The server of claim 1, wherein said processor is further coupled to a plurality of gateways, and wherein said processor is communicatively coupled to each cooling system of the plurality of cooling systems via the plurality of gateways.

11. A method for controlling a plurality of cooling systems, said method comprising:

instructing, a processor of at least one cooling system of the plurality of cooling systems to periodically run a motor in a reverse direction opposite a normal operating direction over a measurement time;

receiving, a measurement sensor data over the measurement time from a motor performance sensor of each of the plurality of cooling systems; and, instructing, the processor of at least one cooling system of the plurality of cooling systems to determine if power draw from the measurement sensor data has exceeded power draw of configuration data stored in local memory.

12. The method of claim 11 further comprising:

receiving, a calibration sensor data over a calibration time from a static air pressure sensor and the motor performance sensor of each of the plurality of cooling systems over a calibration time;

generating first configuration data by executing a first algorithm using the calibration sensor data; and, instructing the processor to write the first configuration data to local memory of the at least one cooling system.

13. The method of claim 12, wherein the static air pressure sensor measures static pressure over a coil of a condenser of a cooling system and the motor performance sensor measures power draw of the motor connected to an axial fan of the cooling system.

14. The method of claim 13, wherein measurement and calibration sensor data includes data measurements from the static air pressure sensor at the coil and motor performance sensors power draw of the motor and wherein the first configuration data includes a fan motor profile generated by executing an algorithm to determine operative static pressure of the cooling system having the motor operating in the reverse direction.

15. The method of claim 14 further comprising determining if power draw from the measurement sensor data exceeds power draw of the first configuration data.

16. The method of claim 15 wherein if power draw from the measurement sensor data has exceeded data values of the fan motor profile of the first configuration data stored, the method further comprises instructing the processor of the respective of cooling system to send alert data to a network.

17. The method of claim 15 wherein if power draw from the measurement sensor data has exceeded data values of the fan motor profile of the first configuration data stored in local memory, the method further comprises instructing the processor of the respective cooling system to run the motor in a forward direction at an increased rotational speed for a period of time such that the coil is de-iced.

18. The method of claim 15 wherein if power draw from the measurement sensor data has exceeded data values of the fan motor profile of the first configuration data stored in local memory, the method further comprises instructing the processor of the respective cooling system to run the motor in the reverse direction for a period of time such that the coil is de-iced.

19. A control system, said control system comprising:

a plurality of cooling systems, each cooling system of said plurality of cooling systems comprising a motor connected to a fan operable in a forward direction and a reverse direction, the fan positioned before a coil of a cooling system of the plurality of cooling systems;

a motor performance sensor;

a local memory; and a processor communicatively coupled to said motor, said motor performance sensor, and said memory and configured to control operation of said motor according to settings defined by configuration data stored in said memory; and a server comprising a processor communicatively coupled to said plurality of cooling systems and communicatively coupled to a memory device configured to store instructions, wherein in response to reading the instructions, said processor is configured to:

instruct the processor of at least one cooling system of the plurality of cooling systems to periodically run the corresponding cooling system motor in a reverse direction opposite a normal operating direction over a measurement time;

receive, from a static air pressure sensor and motor performance sensor of each of a plurality of cooling systems a measurement sensor data over the measurement time; and, instruct the processor of at least one cooling system of the plurality of cooling systems to determine if power draw from the measurement data has exceeded power draw of the configuration data.

20. The control system of claim 19, further comprising a plurality of gateways, wherein each cooling system of said plurality of cooling systems is communicatively coupled to said processor via a gateway of said plurality of gateways and wherein each cooling system further comprises a radio module communicatively coupled to said processor and configured to wirelessly communicate with said gateway.

* * * * *